US006715867B1

(12) United States Patent
Morgavi

(10) Patent No.: US 6,715,867 B1
(45) Date of Patent: Apr. 6, 2004

(54) METHOD FOR MAKING SCRATCHABLE BLOCKS AND SUPPORT COMPRISING SAME

(75) Inventor: Paul Morgavi, La Ciotat (FR)

(73) Assignee: Gemplus (FR)

( * ) Notice: Subject to any disclaimer, the term of this patent is extended or adjusted under 35 U.S.C. 154(b) by 0 days.

(21) Appl. No.: 09/913,592

(22) PCT Filed: Feb. 7, 2000

(86) PCT No.: PCT/FR00/00285

§ 371 (c)(1),
(2), (4) Date: Aug. 16, 2001

(87) PCT Pub. No.: WO00/48844

PCT Pub. Date: Aug. 24, 2000

(30) Foreign Application Priority Data

Feb. 19, 1999 (FR) ..... 99 02125

(51) Int. Cl.[7] ..... B41J 2/01
(52) U.S. Cl. ..... 347/100; 347/105; 428/195
(58) Field of Search ..... 347/100, 105; 428/195; 283/901, 903; 273/138; 235/493

(56) References Cited

U.S. PATENT DOCUMENTS 4,095,824 A 6/1978 Bachman
4,312,268 A 1/1982 King et al.
4,540,628 A * 9/1985 Oberdeck et al. ..... 347/105
4,839,200 A 6/1989 Hoffman et al.
4,992,806 A * 2/1991 Peer ..... 347/88
5,451,052 A * 9/1995 Behm et al. ..... 273/139
5,621,022 A * 4/1997 Jaeger et al. ..... 347/99
5,803,504 A * 9/1998 Deshiens et al. ..... 283/903
5,992,892 A * 11/1999 Schaefer et al. ..... 283/901
6,110,754 A * 8/2000 Silverbrook ..... 347/54
6,152,029 A * 11/2000 Templeton ..... 101/35
6,173,901 B1 * 1/2001 McCannel ..... 235/493

FOREIGN PATENT DOCUMENTS

DE 2506973 A1 * 10/1975 ..... B05D/5/08

* cited by examiner

*Primary Examiner*—Stephen D. Meier
*Assistant Examiner*—Manish Shah
(74) *Attorney, Agent, or Firm*—Burns, Doane, Swecker & Mathis, L.L.P.

(57) ABSTRACT

A method for producing blocks on a support that are designed to be removed by scratching. An ink jet printing technique is used to produce the blocks. The ink used is of the type with phase change. The method can be used to form a support containing an information or a graphic design on its surface and a scratchable block masking the information or graphic design. The scratchable block consists of juxtaposed and/or superposed dots of material. The method is particularly applicable to smart cards.

18 Claims, 1 Drawing Sheet

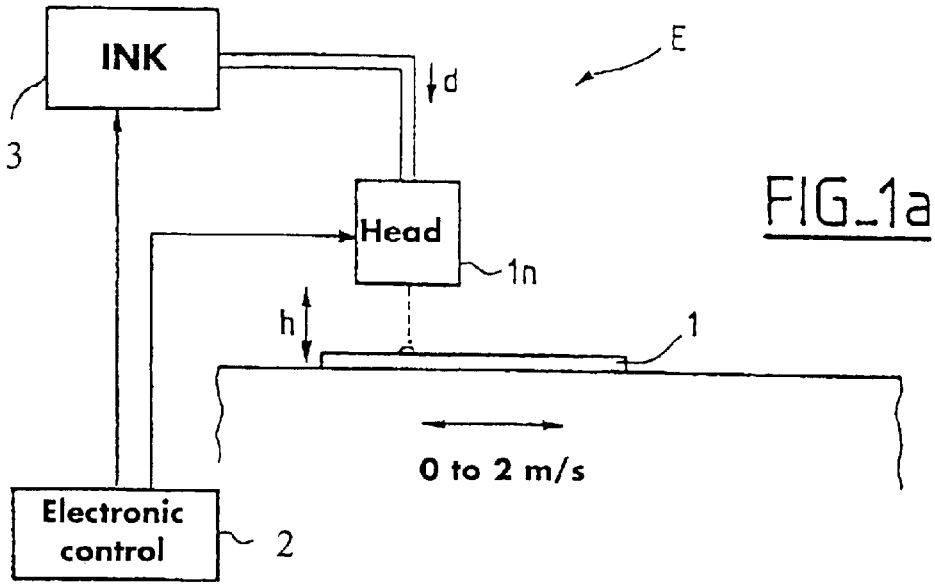
FIG_1a
FIG_1b
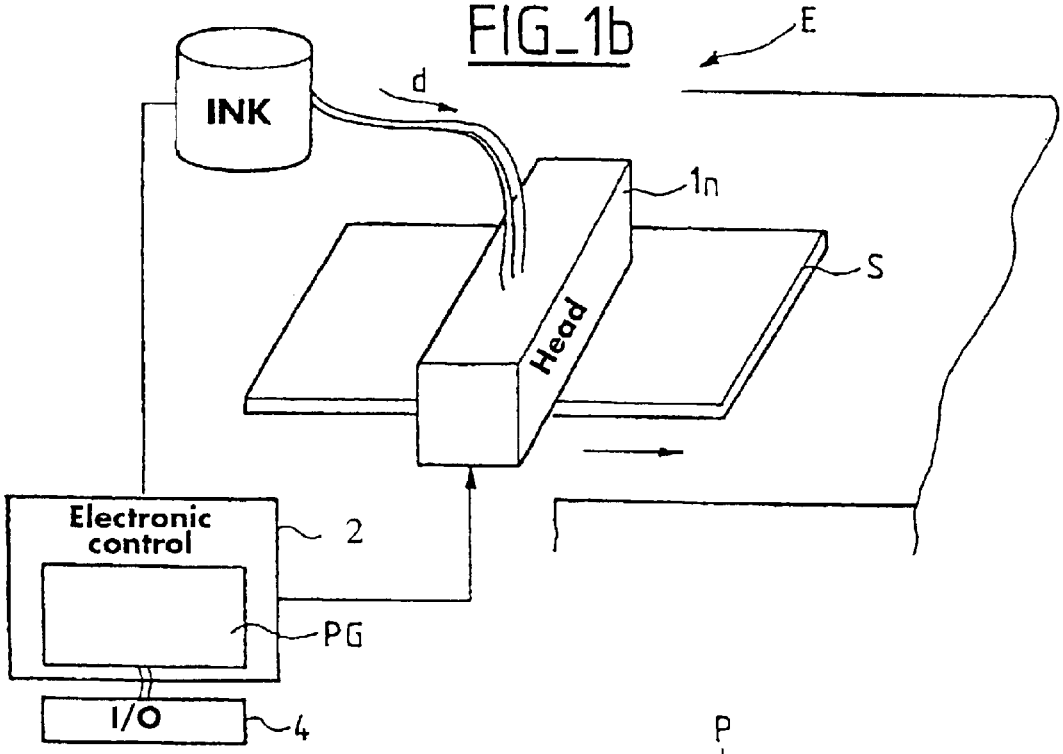
FIG_2
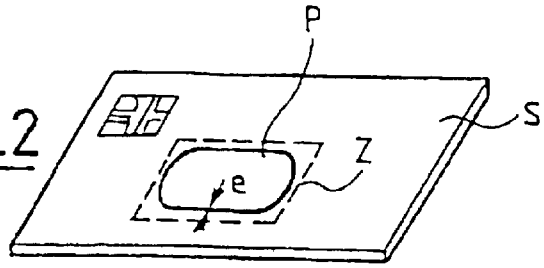

METHOD FOR MAKING SCRATCHABLE BLOCKS AND SUPPORT COMPRISING SAME

This disclosure is based upon, and claims priority from French Application No. 99/02125, filed on Feb. 19, 1999 and International Application No. PCT/FR00/00285, filed Feb. 7, 2000, which was published on Aug. 24, 2000 in a language other than English, the contents of which are incorporated herein by reference.

BACKGROUND OF THE INVENTION

The invention relates to a method for producing scratchable blocks on a support and a support incorporating such a block.

Scratchable blocks means any pattern printed on a support for the purpose of being removed simply by scratching with a nail or any object of sufficient hardness, the objective generally being to discover an inscription or a design printed underneath the said block.

Up to the present time use has been made of screen printing or heat transfer printing technologies for producing the scratchable blocks.

In both cases, the material used for the printing has good covering power and sufficient adhesion with respect to the support in order not to come off by itself, but insufficient adhesion to be able to resist scratching.

However, such technologies are not particularly well suited to mass production because of their low speed of deposition and/or the complexity of use.

However, there are greater and greater moves towards the use en masse of such scratchable blocks, naturally in the field already known, which is the field of games such as lotteries and disposable cards.

The applicant is also moving towards other uses, for example all applications involving portable supports such as smart cards (banking smart cards and/or electronic purses and/or telephone smart cards).

In such applications, the scratchable block could be used for covering for example a number useful to the user.

The existing printing technologies for depositing scratchable layers or scratchable blocks of materials on supports made of paper pulp such as paper or cardboard which exist today, that is to say heat transfer or screen printing methods, are not at all adapted to the problem of productivity, as stated, because of their low speed of deposition and/or their complexity of use.

In addition, the production of more elaborate scratchable blocks, that is to say for example multicolour or multishape, is here also a restrictive element in the technologies currently being used.

SUMMARY OF THE INVENTION

The object of the invention is a method for resolving the problems of speed and dynamic change of size, shape and colour of the scratchable block in the context of an industrial or other use.

The object of the invention is therefore more particularly a method for producing scratchable blocks on a support, principally characterised in that it includes the use of a technique of ink-jet printing.

According to another characteristic of the invention, the ink used is an ink of the phase change type (hot melt, in English terminology).

According to another characteristic, the inks used contain oligomers and polyamides.

According to another characteristic of the invention, the support on which deposits of scratchable blocks can be effected may be a plastic support such as an integrated circuit card (smart card) whatever the standard of the card and whatever the application.

The ink used contains the ester of a hydrogenated abietic acid (a tackifier) and a plasticiser. In the case of printing on a plastic support, the amount of hydrogenated abietic acid ester in the composition of the ink amounts to 16.5% to 27% and that of the plasticiser will respectively be 15% to 4.5%.

According to another characteristic of the invention, the support can be made from rigid paper pulp (cardboard) or flexible paper pulp (paper).

According to another characteristic of the invention, the printing by ink jet is obtained by means of one or more print heads controlled according to the shape, size and/or colour of the block to be produced.

According to another characteristic, the print heads used are of the piezoelectric type.

Another object of the invention is a support containing information or a graphic on one face and a scratchable block masking the said information or graphic. It is characterised in that the said scratchable block is composed of juxtaposed and/or superimposed dots of material.

BRIEF DESCRIPTION OF THE DRAWINGS

Other particularities and advantages of the invention will emerge from a reading of the description made below which is given by way of illustrative and non-limitative examples with regard to the drawings, in which:

FIGS. 1*a* and 1*b* illustrate an item of equipment for implementing the method according to the invention, and FIG. 2 illustrates the result obtained on a support such as a smart card to the ISO format.

DETAILED DESCRIPTION

The method of the invention can be implemented in a different manner by the use of one or more ink-jet print heads according to the application. Thus one or more heads will be used according to the shape which it is desired to obtain for the scratchable block, possibly sized with respect to the size of the head and also according to the fact that it is wished to obtain blocks with a single colour or several colours.

One advantage of the present invention is that the print heads can be positioned in the existing production lines for manufacturing scratchable blocks, replacing the current solutions.

It is therefore possible to have one or more ink-jet heads for covering, through their design or their mechanical positioning, the width of the useful surface to be printed. One or more inks in the same or several colours will be ejected by the ink-jet heads when the object to be processed passes, which can therefore be of the paper, plastic or other type.

The inks which can be used for these applications can for example be of the phase change type (hot melt, in English terminology), which have the advantage of solidifying in contact with the printed surface and which are compatible with a wide variety of supports without any particular processing. These are waxes.

The main material which is used most frequently for phase-change ink-jet applications is wax.

This is because the characteristics of this material lend themselves very well to the cycles of rise and cooling in temperature necessary for this type of technology. The main uses of this type of ink are generally oriented for paper or porous support applications which allow good attachment of the wax-based ink in the fibres of the support.

However, in the context of this invention, the wax has the main defect of not being sufficiently adherent to plastics materials, which gives rise to insufficient resistance to abrasion in the context of this application.

For this purpose, the method described in the invention uses phase-change inks which include oligomers and polyamides. This formulation, used by certain ink manufacturers, improves the adhesion on plastics supports and facilitates the achievement of specific colours necessary for this application.

At the present time, products based on this technology are available from companies such as Data Product, Brother, Polaroid, Markem and Tektronic. These products are generally intended for the printing of supports of the paper or cardboard type.

The ink formulations used by the different manufacturers are very similar and it is possible for example to cite as a reference the Color Stix inks from Tektronic can be summarised in the following way:

monoamide 47%

Tetra Amide 21.5%

Agent for making sticky "Tackifier" 27%

Plasticising agent "Plasticiser" 4.5%

The product for making sticky is an adhesion agent for ink (in English tackifier, which corresponds to a hydrogenated abietic acid ester).

Phase-change inks generally have a softening temperature of around 90° C. and physical characteristics compatible with piezoelectric inkjet technology as from 130° C.

In the context of the invention, the use of the inks generally used for paper applications does not make it possible to have sufficient adhesion on a plastic support for the application in question. In order to improve the adhesion of the ink, changes to formulations are necessary.

In order not to increase the tackifiers in the inks too much, the applicant has preferred to reduce the plasticisers, which are generally of the polymer type, better suited to plastic applications.

One example of a plasticiser used in the context of the invention is di-isonomyl phthalate.

The proportions of tackifier and plasticiser in the composition of the ink can be:

tackifier: 16.5% to 27% plasticiser: 4.5% (with 27% tackifier) to 15% (with 16.5% tackifier).

The thickness of ink deposited varies according to the printing resolution, the formulation of the ink and the temperature, and the nature of the substrate when the drop arrives on the support.

In the context of the invention, the thickness deposited varies between 8 and 20 $\mu$m according to the parameters mentioned above.

An item of equipment E allowing the ink-jet printing of scratchable blocks according to the method of the invention has been shown schematically in FIGS. 1*a* and 1*b*.

This equipment will include for example a print head in controlled by an electronic control 2 which will include a control program PG adapted to the shape and size of the pattern which it is wished to produce.

There is nothing original per se in the electronic control 2, and the existing controls for printing machines used in paper printers can be used for example for controlling this print head. Naturally, the parameters concerning the linear speed of movement of the head, the output d of the ink which flows in the nozzles in the head and the program concerning the pattern to be produced in one pass or several passes of the head over the support, are entered in the memory of the print head control program.

The print head is supplied, with ink by a heated reservoir 3, because of the use of phase-change ink based on temperature variation, in a manner which is also conventional. The reservoir bears the reference 3 in the figures.

The ink-jet heads in, and more particularly the heads based on piezoelectric technology, make it possible to achieve linear printing speeds of around 1 to 2 meters per second, which very greatly exceeds, in terms of rate, what current technologies are capable of achieving.

Another very important advantage of the present invention is that the method makes it possible to produce printings of personalised scratchable blocks because of the addressing capabilities of ink-jet heads.

This is because, according to the required application and resolution, it is possible to use several ink-jet heads. Each head will have a specific colour in order to produce different graphical effects at high speed and which can also be different from one support to another by changing parameter during printing. This change in parameter can be effected by means of an input/output peripheral, connected to the control electronics 2, referenced 4 in the diagram in FIG. 1*b*.

FIG. 2 illustrates a support 1 on which a scratchable block P has been printed in accordance with the method of the invention. This block P has been placed in a printing area Z which is defined, with respect to the borders of the card for example, in the program which controls the print head.

The shape of the block produced and the output of ink for obtaining the required thickness e of the ink which is deposited are also defined in this program.

FIG. 2 illustrates an example embodiment on a plastic support S such as a smart card to the ISO format. As stated before, this support can be a paper or cardboard support produced according to the method of the invention. Naturally, the ink can be replaced by a material and then a jet of material in the broad sense will be spoken of.

The invention relates particularly to the use of material-jet or ink-jet techniques in which it is possible to actuate or control unitarily each jet of one drop or blocks of n simultaneous jets each of one drop.

More precisely, the support contains information or a graphic on one face and a scratchable block masking the said information or graphic. The scratchable block is composed of juxtaposed and/or superimposed dots of material. These dots result from the impact of drops of material, notably drops of ink sprayed by material jet in general or ink jet onto the support.

The dots have a resolution greater than 100 dpi. Preferably the resolution is between 100 and 600 dpi.

When the colour effect offered by the technology of the invention is used, it is possible to obtain a block containing dots of different colours.

Advantageously, the coloured dots can form a decorative pattern or information or a security element such as guilloches for increasing the interference with or camouflage of the masked information.

The security pattern can be regular or random, visible or not from the outside. It can be in the same colour as the information or graphic placed on the support so as to merge with it. The pattern can be directly in contact with the information or graphic or be substantially at the same level. It can comprise at least one layer of dots of material or ink on top with an even colour or otherwise.

What is claimed is:

1. A method for producing a scratchable block that masks an underlying image on a support and that is designed to be removed from the support by scratching to reveal said underlying image, which includes the step of printing an ink of the phase-change type on the support by an inkjet technique to form said block.

2. A method for producing scratchable blocks according to claim 1, wherein the inks used in said technique contain oligomers and polyamides.

3. A method for producing scratchable blocks according to claim 1, wherein the support is made from plastic.

4. A method for producing scratchable blocks according to claim 3, wherein the ink contains a hydrogenated abietic acid ester and a plasticiser, and wherein the proportion of said ester in the composition of the ink is 16.5% to 27% whilst that of the plasticiser is respectively 15% to 4.5%.

5. A method for producing scratchable blocks according to claim 1, wherein the support is made from paper pulp.

6. A method for producing scratchable blocks according to claim 1, wherein the printing by ink jet is obtained by means of one or more print heads controlled according to at least one of the shape, size and colour of the block to be produced.

7. A method for producing scratchable blocks according to claim 6, wherein the ink-jet print heads are of the piezoelectric type.

8. A support containing information or a graphic on one face and a scratchable block masking said information or graphic, wherein said scratchable block comprises juxtaposed and/or superimposed dots of material having a resolution greater than 100 dpi obtained by the use of an ink-jet printing technique.

9. A support according to claim 8, wherein the dots have different colours.

10. A support according to claim 9, wherein the dots of different colours form a pattern.

11. A support according to claim 10, wherein the dots of different colours form a regular or random security pattern.

12. A support according to claim 11, wherein the security pattern is directly in contact with said information or said graphic.

13. A support according to claim 11, wherein the security pattern is at substantially the same level as said information or graphic.

14. A support according to claim 11, wherein said security pattern is visible from the exterior of the support.

15. A support according to claim 8, wherein said support is made of a plastic material.

16. A support according to claim 8, wherein said support comprises a smart card.

17. A support made of a plastic material and containing information or a graphic on one face and a scratchable block masking said information or graphic, wherein said scratchable block comprises juxtaposed and/or superimposed dots of a phase-change ink deposited by the use of an ink-jet printing technique.

18. A support comprising a smart card and containing information or a graphic on one face and a scratchable block masking said information or graphic, wherein said scratchable block comprises juxtaposed and/or superimposed dots of a phase-change ink deposited by the use of an ink-jet printing technique.

* * * * *